United States Patent [19]

Petzold et al.

[11] Patent Number: 4,729,486

[45] Date of Patent: Mar. 8, 1988

[54] LIFT ENHANCING BEAM ATTACHMENT WITH MOVABLE COUNTERWEIGHTS

[75] Inventors: Terry L. Petzold, Kiel; David J. Pech, Manitowoc, both of Wis.

[73] Assignee: The Manitowoc Company, Inc., Manitowoc, Wis.

[21] Appl. No.: 849,165

[22] Filed: Apr. 7, 1986

[51] Int. Cl.[4] ..... B66C 23/72

[52] U.S. Cl. ..... 212/189; 212/197

[58] Field of Search ..... 212/156, 189, 195–198

[56] References Cited

U.S. PATENT DOCUMENTS

| | | | |
|---|---|---|---|
| 524,619 | 8/1894 | Sturm . | |
| 970,773 | 9/1910 | Wylie . | |
| 3,202,299 | 8/1965 | Decuir . | |
| 3,209,920 | 10/1965 | De Cuir . | |
| 3,240,353 | 3/1966 | Leavesley | 212/156 |
| 3,386,010 | 9/1974 | Lampson | 212/49 |
| 3,435,961 | 4/1969 | Hamson | 212/197 |
| 3,485,383 | 12/1969 | Beduhn | 212/48 |
| 3,842,984 | 10/1974 | Brown et al. . | |
| 3,878,944 | 4/1975 | Beduhn et al. . | |
| 3,921,815 | 11/1975 | Brown et al. . | |
| 3,955,684 | 5/1976 | Novotny | 212/197 |
| 4,042,115 | 8/1977 | Beduhn et al. . | |
| 4,084,777 | 4/1978 | Lambert | 212/189 |
| 4,103,783 | 8/1978 | Beduhn et al. . | |
| 4,118,054 | 10/1978 | Vigerie | 212/189 |
| 4,170,309 | 10/1979 | Lampson . | |
| 4,196,816 | 4/1980 | Dvorsky et al. . | |
| 4,243,148 | 1/1981 | Lampson . | |
| 4,258,852 | 3/1981 | Juergens . | |
| 4,280,627 | 7/1981 | Becker | 212/198 |
| 4,316,548 | 2/1982 | Helm et al. . | |
| 4,358,021 | 11/1982 | Helm et al. . | |
| 4,387,813 | 6/1983 | Beduhn et al. . | |
| 4,387,814 | 6/1983 | Beduhn et al. . | |
| 4,449,635 | 5/1984 | Helm et al. . | |
| 4,537,317 | 8/1985 | Jensen . | |
| 4,540,097 | 9/1985 | Wadsworth et al. | 212/198 |
| 4,557,390 | 12/1985 | Mick . | |
| 4,601,402 | 7/1986 | Helm et al. . | |
| 4,614,275 | 9/1986 | Zenno | 212/198 |

*Primary Examiner*—Sherman D. Basinger
*Assistant Examiner*—Stephen P. Avila
*Attorney, Agent, or Firm*—Leydig, Voit & Mayer

[57] ABSTRACT

An attachment for increasing the lifting capacity of a crane having a mobile lower works with an upper works including a rear portion rotatably mounted thereon and having a pivotally mounted boom and an upwardly and rearwardly projecting mast carried on the upper works with means for lifting a load from the top of the boom and rigging means interconnecting the top of the boom, the top of the mast and the rear portion of the upper works, including a counterweight support beam detachably connected to the crane upper works and extending rearwardly therefrom, a counterweight assembly including a movable carrier mounted on the support beam for movement along the length thereof, an actuator for selectively moving the counterweight carrier fore and aft along the beam, a leg for normally supporting the trailing end of the beam on the ground, and a rear pendant interconnecting the trailing end of the beam and the top of the mast for raising the leg from the ground incident to lifting a heavy load from the boom.

10 Claims, 5 Drawing Figures

LIFT ENHANCING BEAM ATTACHMENT WITH MOVABLE COUNTERWEIGHTS

FIELD OF THE INVENTION

The present invention relates generally to heavy lift cranes and more particularly concerns a lift enhancing attachment for mobile heavy lift cranes.

BACKGROUND OF THE INVENTION

Conventional lift cranes include a rotatable body or upper works mounting the lift boom and machinery that rotate about a vertical axis on a lower works or body. If the crane is mobile, the lower works or body is typically crawler mounted. The lifting capacity of a mobile crane is largely determined by the geometry of the base since all of the compression and tilting loads must act through and around the mobile base to the ground. The constant demands for increasing crane capacity have been partly met by larger-sized cranes having bigger lower bodies, both for more strength and to further space the fulcrum or tipping point of the crane from the counterweight effective line of action. These larger cranes have also been provided with increasing amounts of counterweight carried on the rotatable upper works which resist the overturning moment of the larger loads.

A significant increase in crane capacity was achieved by providing a self-propelled crane with the support ring and extended boom carrier disclosed and claimed in U.S. Pat. Nos. 3,485,383; 3,878,944; and 4,196,816. In these designs, the weight of the crane and its load is transferred to the ground through a large diameter, track-like ring. As shown in these patents, and as practiced commercially for some years, the support ring is either blocked into place by timbers fitted or wedged beneath and completely around the ring or is supported by a plurality of jacks spaced around the periphery of the ring. While such cranes have increased counterweight and lift capacities, they are no longer mobile under heavy loads.

Further refinements in ring supported cranes are disclosed in U.S. Pat. Nos. 4,042,115; 4,103,783; 4,387,813 and 4,387,814. These patents disclose inter alia that a separate transporter mechanism may be run in and out of an otherwise stationary ring supported crane in order to move that crane between different locations or transporter mechanisms and/or idle crawlers or dollies may be installed beneath the ring under the boom foot and counterweight. Additional ring segments of even greater radius, which may also be mounted on mobile transporter mechanisms, are disclosed in U.S. Pat. Nos. 4,316,548; 4,358,021; 4,449,635 and co-pending application Ser. No. 259,932, filed May 4, 1981, now U.S. Pat. No. 4,601,402. Other arrangements for forwardly extending the boom foot or load fulcrum point are disclosed in "TransiLift" type cranes such as in U.S. Pat. Nos. 3,836,010; 4,170,309; 4,243,148; 4,537,317 and 4,555,032.

Conversely, attempts have been made to increase crane capacity by adding free-swinging counterweights such as disclosed in U.S. Pat. Nos. 3,202,299 and 3,209,920 or through the use of "Sky-Horse" type counterweight trailers such as disclosed in U.S. Pat. Nos. 3,842,984, 3,921,815 and 4,258,852 or suspended counterweight control systems as disclosed in U.S. Pat. No. 4,557,390. Reference may also be made to much earlier movable counterweight control systems for pedestal mounted cranes such as U.S. Pat. No. 524,619 wherein the counterweight position is directly dependent on the load line tension and U.S. Pat. No. 970,773 wherein the counterweight is swung out rearwardly in opposition to the forward reach of a jib.

None of these prior art arrangements, however, provides a fully satisfactory arrangement for increasing the lift capacity of a mobile crane while maintaining full mobility and maneuverability of the crane on its own crawler base and also permitting full swinging movement of the crane upper under both load and no load conditions without undue swinging and counterbalancing forces being created by the suspended counterweight mechanism.

OBJECTS AND SUMMARY OF THE INVENTION

Accordingly, it is the primary aim of the present invention to provide a lift enhancing arrangement for a mobile crane wherein the crane is fully mobile and swingable both while lifting heavy loads and while unloaded. A further object is to provide such a lift enhancing arrangement of the above type in the form of a relatively simple attachment for significantly increasing the lift capacity of a conventional mobile crane.

These and other objects and advantages of the invention will become more readily apparent upon reading the following detailed description and upon reference to the drawings, in which:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
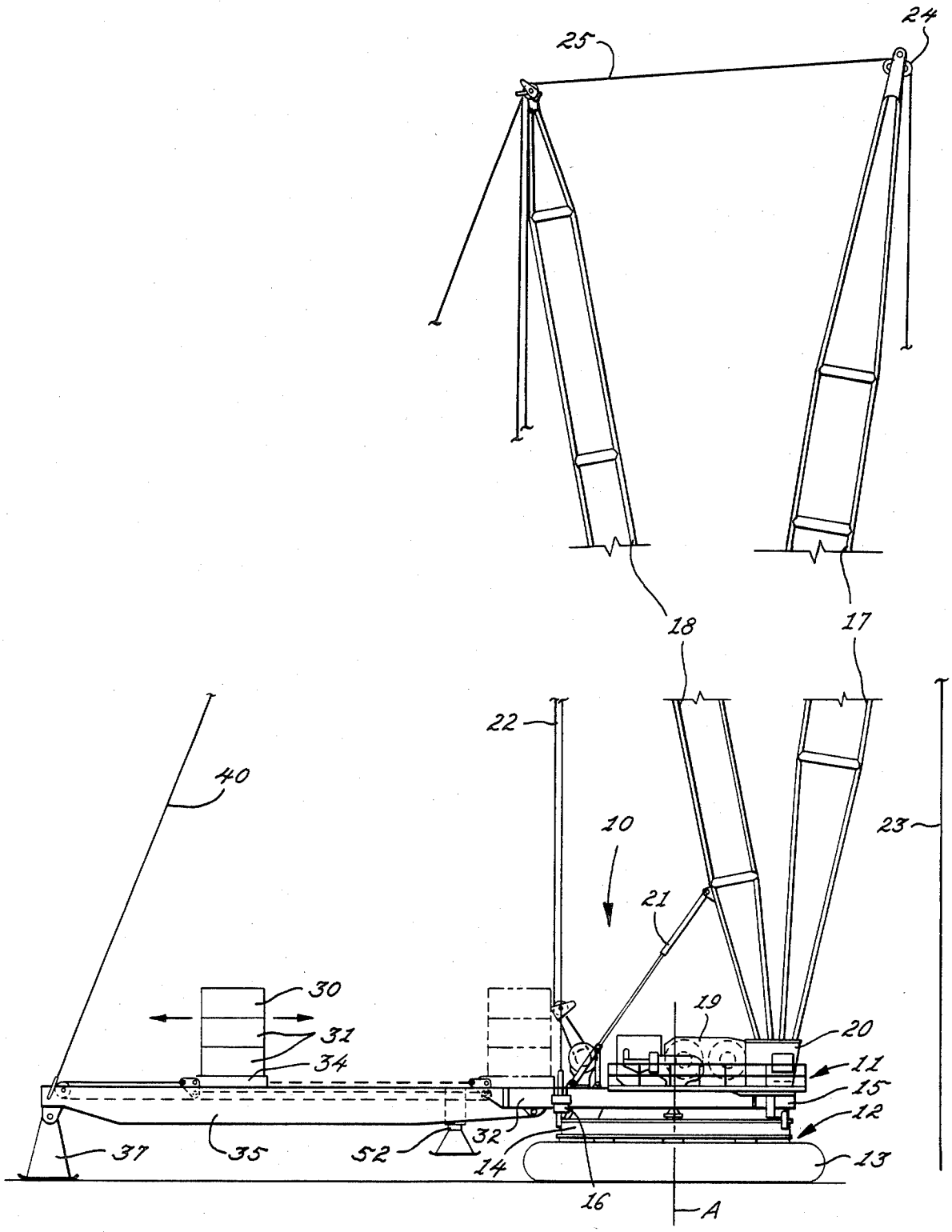
FIG. 1 is a side elevation of a mobile heavy lift crane with the novel lift enhancing beam attachment of the present invention.

Turning now to the drawings, there is shown in FIG. 1, a heavy lift crane 10 having an upper works 11 mounted for rotation about a vertical axis A on a mobile lower works 12 having self-propelled crawler tracks 13. The crane lower works 12 preferably includes an enlarged track-like ring or turntable 14 and the upperworks 11 includes a rotatable bed or deck 15 supported by suitable rollers 16 for 360° swinging movement on the ring 14. The crane deck 15 carries a pivotably mounted boom 17, an upwardly and rearwardly projecting mast 18, power lift winch machinery 19 and an operator's cab 20. In the illustrated embodiment, the mast 18 is held in a substantially fixed rearwardly inclined position by a strut or mast stop arrangement 21 and the top of the mast 18 is connected to the rear of the crane deck 15 by back pendants 22.

In order to lift a load, a lift line 23 (which may include multiple parts of line) is trained over a sheave assembly 24 at the top of the boom and the lift line is drawn in or paid out by one or more drums forming part of the winch machinery 19. To adjust the boom angle, live rigging 25 connecting the top of the boom is trained over a sheave assembly at the top of the mast and is drawn in or paid out by a boom hoist winch and gantry assembly mounted on the rear of the crane deck 15. The crane 10 thus far described is substantially like that described in U.S. Pat. No. 4,195,740, which is hereby incorporated by reference. Cranes of this type are sold commercially by The Manitowoc Company, Inc. as their Model 7000 crane.

In its normal mobile lift crane configuration, the crane 10, as just described, is provided with a counterweight assembly 30 comprising a plurality of counterweight units or boxes 31 supported on a rearwardly extending portion 32 of the crane deck 15. It will be understood that the forward tipping moment imposed on the crane 10 by a heavy load connected to the lift line 23 is carried back from the boom top through the live rigging 25 to the mast top and down through the back pendants 22 to the rear portion 32 of the crane deck which supports the counterweight assembly 30.

For comparative purposes, a crane 10 of this type with a 300' boom, a 170' mast and 778,000 lb. counterweight may have a nominal maximum lift capacity of 199,400 lb. at a 150' working radius and a capacity of 96,100 lb. at a 250' radius. Consistent with crane industry rating standards, these capacities do not exceed 75% of tipping loads of crawler mounted cranes.

Figure 2:
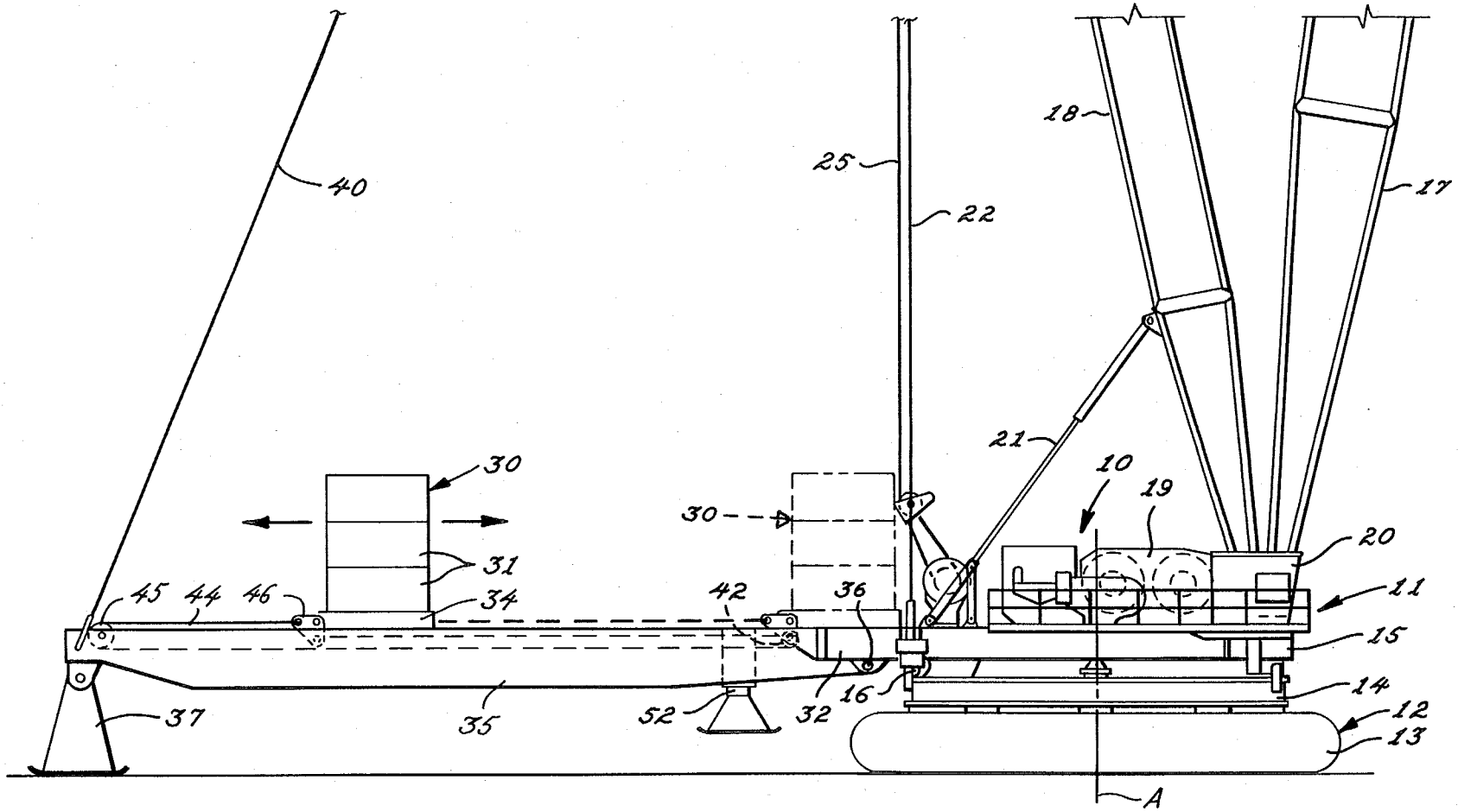
FIG. 2 is an enlarged, fragmentary side elevation of the crane and lift enhancing attachment shown in FIG. 1.
Figure 3:
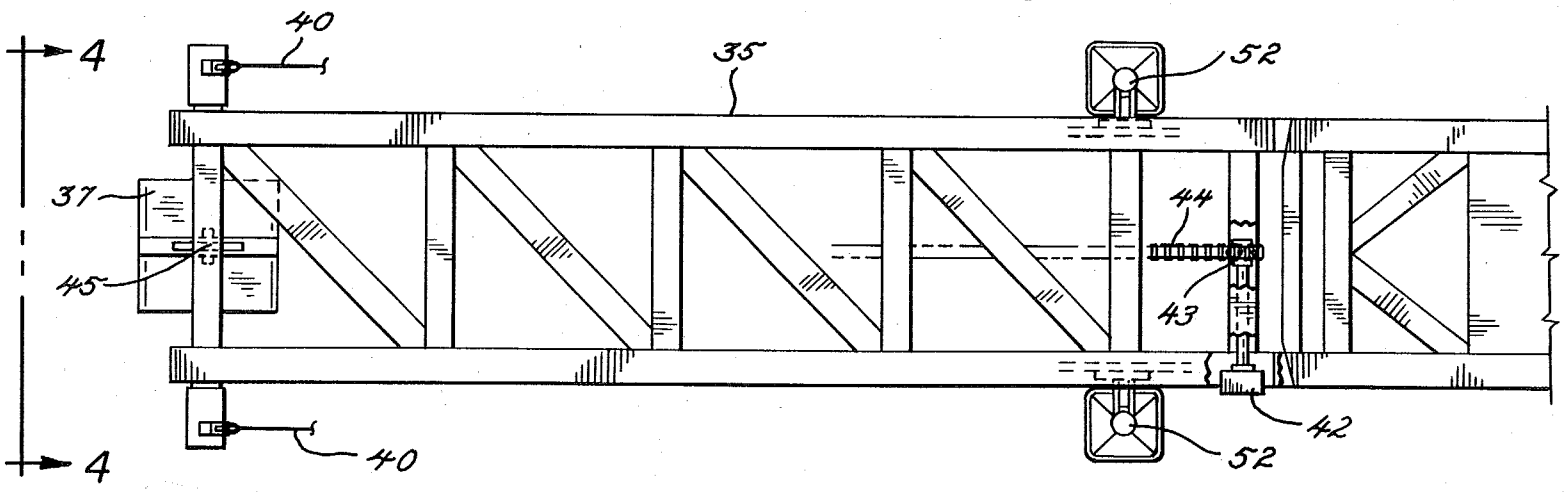
FIG. 3 is a further enlarged plan view of the lift enhancing attachment of FIGS. 1 and 2.

Pursuant to the present invention, attachment means are provided for significantly enhancing the lift capacity of the crane 10 while permitting the crane to remain fully mobile and swingable during both heavy load lifting and while unloaded. Referring now to FIGS. 2 and 3, the lift enhancing means includes a rearwardly extending counterweight support beam 35 detachably connected to the rear portion 32 of the crane deck 15 by suitable means such as by removable pins 36. In the illustrated embodiment, the trailing end of the beam 35 is provided with a downwardly projecting stand or leg 37 to normally support the beam 35 on the ground in substantially horizontal fashion when the beam is pinned to the crane 10. Preferably, the leg 37 is pivotally mounted on the beam 35 so that the leg may be folded up into a substantially horizontal position, if desired, for storage.

In further accordance with the invention, the trailing end of the counterweight support beam 35 is connected to the top of the mast 18 by an auxiliary back hitch pendant 40 and the counterweight assembly 30 includes a movable counterweight carrier or slide tray 34 mounted for movement along the length of the beam. In the illustrated embodiment, the means for moving the counterweight assembly 30 includes a reversible actuator such as a hydraulic motor 42 which drives a sprocket 43 around which a drive chain 44 is trained. The drive chain 44 is also trained around an idler sprocket 45 journalled at the trailing end of the beam and the ends of the chain 44 are anchored to a pull bracket 46 mounted on the carrier 34 of the counterweight assembly 30.

Figure 4B:
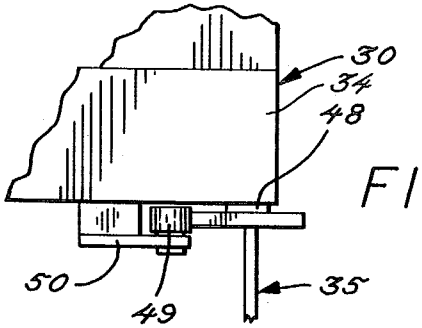
FIG. 4*b* is an enlarged, fragmentary detail of a portion of the counterweight and frame of the lift enhancing attachment of FIGS. 1–3.
Figure 4A:
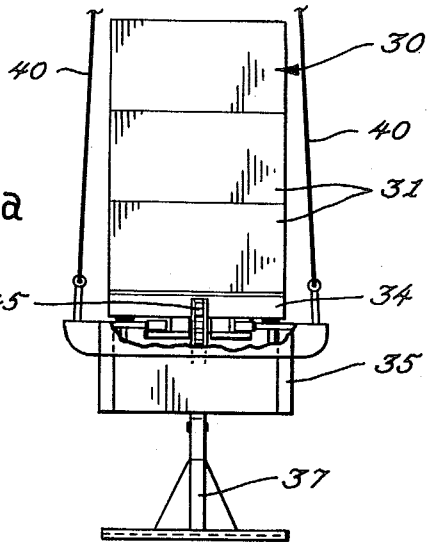
FIG. 4*a* is a rear elevation view of the lift enhancing attachment substantially as seen along line 4—4 in FIG. 3.

As shown in FIGS. 4*a* and 4*b*, the counterweight assembly 30 may be slidably mounted on the beam 35 by means of bearing blocks 48 interposed between the carrier 34 and beam 35 and the carrier is guided by rollers 49 in a bracket 50. The beam may be made of a generally open box-like section with deep I-beam side rails and suitable cross lacings.

To support the beam 35 during attachment to the crane 10, a pair of lift jacks 52 are preferably mounted on the beam 35 adjacent its forward end. The jacks may be extended to support the beam 35 on the ground during both attachment and detachment from the crane.

By moving the counterweight assembly rearwardly on the beam, the lifting capacity of the crane is enhanced. For example, with 550,000 lb. of movable counterweight positioned adjacent the rear end of the beam 35 (48' in length) and 228,000 lb. of stationary counterweight on the crane deck, the nominal lifting capacity of the crane of the previous example is increased to 341,6000 lb. at 150' radius and 177,400 lb. at 250' radius.

By suitably adjusting the length of the back pendant 22 and the auxiliary pendant 40, the trailing end of the counterweight beam 35 and the leg 37 may be lifted clear of the ground upon lifting a heavy load. With the leg lifted off the ground, the crane 10 is fully mobile on the crawler tracks 13 and the upper works 11 is fully swingable on the ring 14. When it is desired to lift only light loads or no load at all the counterweight assembly 30 may be moved forward on the beam 35 and parked on the rear portion of the crane deck.

In the preferred embodiment, sensor means are provided for indicating when the support leg 37 is lifted from the ground and a suitable signal transmitted to the operator's cab. Also, a load indicator may be incorporated in the crane 10 and utilized for positioning the counterweight 30 on the beam 35 in accordance with the load being lifted.

We claim as our invention:

1. An attachment for increasing the lifting capacity of a crane having a mobile lower works with an upper works including a rear portion rotatably mounted on the lower works and having a pivotally mounted boom and an upwardly and rearwardly projecting mast carried on the upper works with means for lifting a load from the top of the boom and rigging means interconnecting the top of the boom and the top of the mast, comprising in combination, means interconnecting the top of the mast and the rear portion of the upper works for opposing a load lifted from the top of the boom, a counterweight support beam detachably connected to the crane upper works and extending rearwardly from the rear portion of the upper works, a counterweight assembly including a movable carrier mounted on the support beam for movement along the length thereof, means for selectively moving the counterweight carrier fore and aft along the beam, leg means for normally supporting the trailing end of the beam on the ground, and means interconnecting the trailing end of the beam and the top of the mast for raising the leg means from the ground incident to lifting a heavy load from the boom.

2. An attachment as defined in claim 1 including jack means mounted on the forward end of the beam for selectively supporting the forward end thereof on the ground.

3. An attachment as defined in claim 1 wherein the beam is pinned to the upper works for limited vertical pivotal movement.

4. An attachment as defined in claim 1 wherein the leg means is pivotally mounted on the trailing end of the beam for movement into a substantially horizontal storage position.

5. An attachment as defined in claim 1 including means interposed between the beam and the counterweight carrier for guiding the movement of the counterweight carrier along the beam.

6. An attachment as defined in claim 5 including bearing means interposed between the beam and the counterweight carrier for movably supporting the counterweight carrier on the beam.

7. An attachment as defined in claim 1 including actuator means for moving the counterweight carrier along the length of the beam and means for selectively and reversibly operating the actuator means.

8. An attachment as defined in claim 7 wherein the actuator means includes a hydraulic motor and a drive linkage for pulling the counterweight carrier fore and aft along the beam.

9. An attachment as defined in claim 1 wherein the counterweight carrier is movable onto the rear portion of the crane upper works when it is desired to detach the beam from the crane.

10. An attachment as defined in claim 9 including jacks mounted on the forward end of the beam for supporting the beam on the ground during attachment and detachment of the beam with respect to the crane upper works.

* * * * *